US006397175B1

(12) United States Patent
Manjunath

(10) Patent No.: US 6,397,175 B1
(45) Date of Patent: May 28, 2002

(54) METHOD AND APPARATUS FOR SUBSAMPLING PHASE SPECTRUM INFORMATION

(75) Inventor: Sharath Manjunath, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/356,491

(22) Filed: Jul. 19, 1999

(51) Int. Cl.[7] ..... G10L 11/04
(52) U.S. Cl. ..... 704/207; 704/219; 704/230
(58) Field of Search ..... 704/230, 219, 704/222, 220, 203, 261, 262, 207, 208, 216, 223, 501

(56) References Cited

U.S. PATENT DOCUMENTS

| | | | | |
|---|---|---|---|---|
| 4,901,307 A | | 2/1990 | Gilhousen et al. | 370/18 |
| 5,067,158 A | * | 11/1991 | Arjmand | 704/219 |
| 5,103,459 A | | 4/1992 | Gilhousen et al. | 375/1 |
| 5,414,796 A | | 5/1995 | Jacobs et al. | 395/2.3 |
| 5,692,098 A | * | 11/1997 | Kurdziel | 704/202 |
| 5,724,480 A | * | 3/1998 | Yamaura | 704/219 |
| 5,727,123 A | | 3/1998 | McDonough et al. | 395/2.33 |
| 5,884,253 A | | 3/1999 | Kleijn | 704/223 |
| 5,911,128 A | | 6/1999 | DeJaco | 704/221 |
| 6,138,089 A | * | 10/2000 | Guberman | 704/207 |

FOREIGN PATENT DOCUMENTS

| | | |
|---|---|---|
| EP | 0751492 | 1/1997 |
| WO | 0030073 | 5/2000 |

OTHER PUBLICATIONS

1978 Digital Processing of Speech Signals, "Linear Predictive Coding of Speech", L.R. Rabiner et al., pp. 396–453.
1988 Proceedings of the Mobile Satellite Conference, "A 4.8 KBPS Code Excited Linear Predictive Coder", T. Tremain et al., pp. 491–496.
1991 Digital Signal Processing, "Methods for Waveform Interpolation in Speech Coding", W. Bastiaan Kleijn, et al., pp. 215–230.
H. Li, et al., "*Non–Linear Interpolation in Prototype Waveform Interpolation (PWI) Encoders*," IEE Colloquium on Speech Coding—Techniques and Applications, GB IEE, London. Jun. 1, 1994, pp. 1–5.

* cited by examiner

*Primary Examiner*—Richemond Dorvil
*Assistant Examiner*—Daniel Abebe
(74) *Attorney, Agent, or Firm*—Philip Wadsworth; Kent D. Baker; Thomas R. Rouse

(57) ABSTRACT

A method and apparatus for subsampling phase spectrum information includes a speech coder for analyzing and reconstructing a prototype of a frame by using intelligent subsampling of phase spectrum information of the prototype. To analyze the prototype, the speech coder produces a phase parameters of a reference prototype, generates phase parameters of a current prototype, and correlates the phase parameters of the current prototype with the phase parameters of the reference prototype in multiple frequency bands. To reconstruct the prototype using linear phase shift values, the speech coder produces a phase parameters of the reference prototype, generates a set of linear phase shift values associated with the prototype, and composes a phase vector from the phase parameters and the linear phase shift values across multiple frequency bands. To reconstruct the prototype using circular rotation values, the speech coder produces a set of circular rotation values associated with the prototype, generates a set of bandpass waveforms in multiple frequency bands, the bandpass waveforms being associated with the phase parameters of the reference prototype, and modifes the bandpass waveforms based upon the circular rotation values.

77 Claims, 9 Drawing Sheets

METHOD AND APPARATUS FOR SUBSAMPLING PHASE SPECTRUM INFORMATION

BACKGROUND OF THE INVENTION

1. Field of the Invention

The present invention pertains generally to the field of speech processing, and more specifically to methods and apparatus for subsampling phase spectrum information to be transmitted by a speech coder.

2. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices for compressing speech find use in many fields of telecommunications. An exemplary field is wireless communications. The field of wireless communications has many applications including, e.g., cordless telephones, paging, wireless local loops, wireless telephony such as cellular and PCS telephone systems, mobile Internet Protocol (IP) telephony, and satellite communication systems. A particularly important application is wireless telephony for mobile subscribers.

Various over-the-air interfaces have been developed for wireless communication systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, IS-95B, proposed third generation standards IS-95C and IS-2000, etc. (referred to collectively herein as IS-95), are promulgated by the Telecommunication Industry Association (TIA) and other well known standards bodies to specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307, which are assigned to the assignee of the present invention and fully incorporated herein by reference.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Perhaps most important in the design of a speech coder is the search for a good set of parameters (including vectors) to describe the speech signal. A good set of parameters requires a low system bandwidth for the reconstruction of a perceptually accurate speech signal. Pitch, signal power, spectral envelope (or formants), amplitude spectra, and phase spectra are examples of the speech coding parameters.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_0$, per frame to preserve the accuracy of the time-domain speech waveform. Such coders typically deliver excellent voice quality provided the number of bits, $N_0$, per frame relatively is large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications. Hence, despite improvements over time, many CELP coding systems operating at low bit rates suffer from perceptually significant distortion typically characterized as noise.

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in U.S. application Ser. No. 09/217,341, entitled VARIABLE RATE SPEECH CODING, filed Dec. 21, 1998, assigned to the assignee of the present invention, and fully incorporated herein by reference. Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (nonspeech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, typically characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or on the speech signal. An exemplary PWI, or PPP, speech coder is described in U.S. application Ser. No. 09/217,494, entitled PERIODIC SPEECH CODING, filed Dec. 21, 1998, assigned to the assignee of the present invention, and fully incorporated herein by reference. Other PWI, or PPP, speech coders are described in U.S. Pat. No. 5,884,253 and W. Bastiaan Kleijn & Wolfgang Granzow *Methods for Waveform Interpolation in Speech Coding*, in 1 *Digital Signal Processing* 215–230 (1991).

In many conventional speech coders, the phase parameters of a given pitch prototype are each individually quantized and transmitted by the encoder. Alternatively, the phase parameters may be vector quantized in order to conserve bandwidth. However, in a low-bit-rate speech coder, it is advantageous to transmit the least number of bits possible to maintain satisfactory voice quality. For this reason, in some conventional speech coders, the phase parameters may not be transmitted at all by the encoder, and the decoder may either not use phases for reconstruction, or use some fixed, stored set of phase parameters. In either case the resultant voice quality may degrade. Hence, it would be desirable to provide a low-rate speech coder that reduces the number of elements necessary to transmit phase spectrum information from the encoder to the decoder, thereby transmitting less phase information. Thus, there is a need for a speech coder that transmits fewer phase parameters per frame.

SUMMARY OF THE INVENTION

The present invention is directed to a speech coder that transmits fewer phase parameters per frame. Accordingly, in one aspect of the invention, a method of processing a prototype of a frame in a speech coder advantageously includes the steps of producing a plurality of phase parameters of a reference prototype; generating a plurality of phase parameters of the prototype; and correlating the phase parameters of the prototype with the phase parameters of the reference prototype in a plurality of frequency bands.

In another aspect of the invention, a method of processing a prototype of a frame in a speech coder advantageously includes the steps of producing a plurality of phase parameters of a reference prototype; generating a plurality of linear phase shift values associated with the prototype; and composing a phase vector from the phase parameters and the linear phase shift values across a plurality of frequency bands.

In another aspect of the invention, a method of processing a prototype of a frame in a speech coder advantageously includes the steps of producing a plurality of circular rotation values associated with the prototype; generating a plurality of bandpass waveforms in a plurality of frequency bands, the plurality of bandpass waveforms being associated with a plurality of phase parameters of a reference prototype; and modifying the plurality of bandpass waveforms based upon the plurality of circular rotation values.

In another aspect of the invention, a speech coder advantageously includes means for producing a plurality of phase parameters of a reference prototype of a frame; means for generating a plurality of phase parameters of a current prototype of a current frame; and means for correlating the phase parameters of the current prototype with the phase parameters of the reference prototype in a plurality of frequency bands.

In another aspect of the invention, a speech coder advantageously includes means for producing a plurality of phase parameters of a reference prototype of a frame; means for generating a plurality of linear phase shift values associated with a current prototype of a current frame; and means for composing a phase vector from the phase parameters and the linear phase shift values across a plurality of frequency bands.

In another aspect of the invention, a speech coder advantageously includes means for producing a plurality of circular rotation values associated with a current prototype of a current frame; means for generating a plurality of bandpass waveforms in a plurality of frequency bands, the plurality of bandpass waveforms being associated with a plurality of phase parameters of a reference prototype of a frame; and means for modifying the plurality of bandpass waveforms based upon the plurality of circular rotation values.

In another aspect of the invention, a speech coder advantageously includes a prototype extractor configured to extract a current prototype from a current frame being processed by the speech coder; and a prototype quantizer coupled to the prototype extractor and configured to produce a plurality of phase parameters of a reference prototype of a frame, generate a plurality of phase parameters of the current prototype, and correlate the phase parameters of the current prototype with the phase parameters of the reference prototype in a plurality of frequency bands.

In another aspect of the invention, a speech coder advantageously includes a prototype extractor configured to extract a current prototype from a current frame being processed by the speech coder; and a prototype quantizer coupled to the prototype extractor and configured to produce a plurality of phase parameters of a reference prototype of a frame, generate a plurality of linear phase shift values associated with the current prototype, and compose a phase vector from the phase parameters and the linear phase shift values across a plurality of frequency bands.

In another aspect of the invention, a speech coder advantageously includes a prototype extractor configured to extract a current prototype from a current frame being processed by the speech coder; and a prototype quantizer coupled to the prototype extractor and configured to produce a plurality of circular rotation values associated with the current prototype, generate a plurality of bandpass waveforms in a plurality of frequency bands, the plurality of bandpass waveforms being associated with a plurality of phase parameters of a reference prototype of a frame, and modify the plurality of bandpass waveforms based upon the plurality of circular rotation values.

DETAILED DESCRIPTION OF THE PREFERRED EMBODIMENTS

The exemplary embodiments described hereinbelow reside in a wireless telephony communication system configured to employ a CDMA over-the-air interface. Nevertheless, it would be understood by those skilled in the art that a subsampling method and apparatus embodying features of the instant invention may reside in any of various communication systems employing a wide range of technologies known to those of skill in the art.

Figure 1:
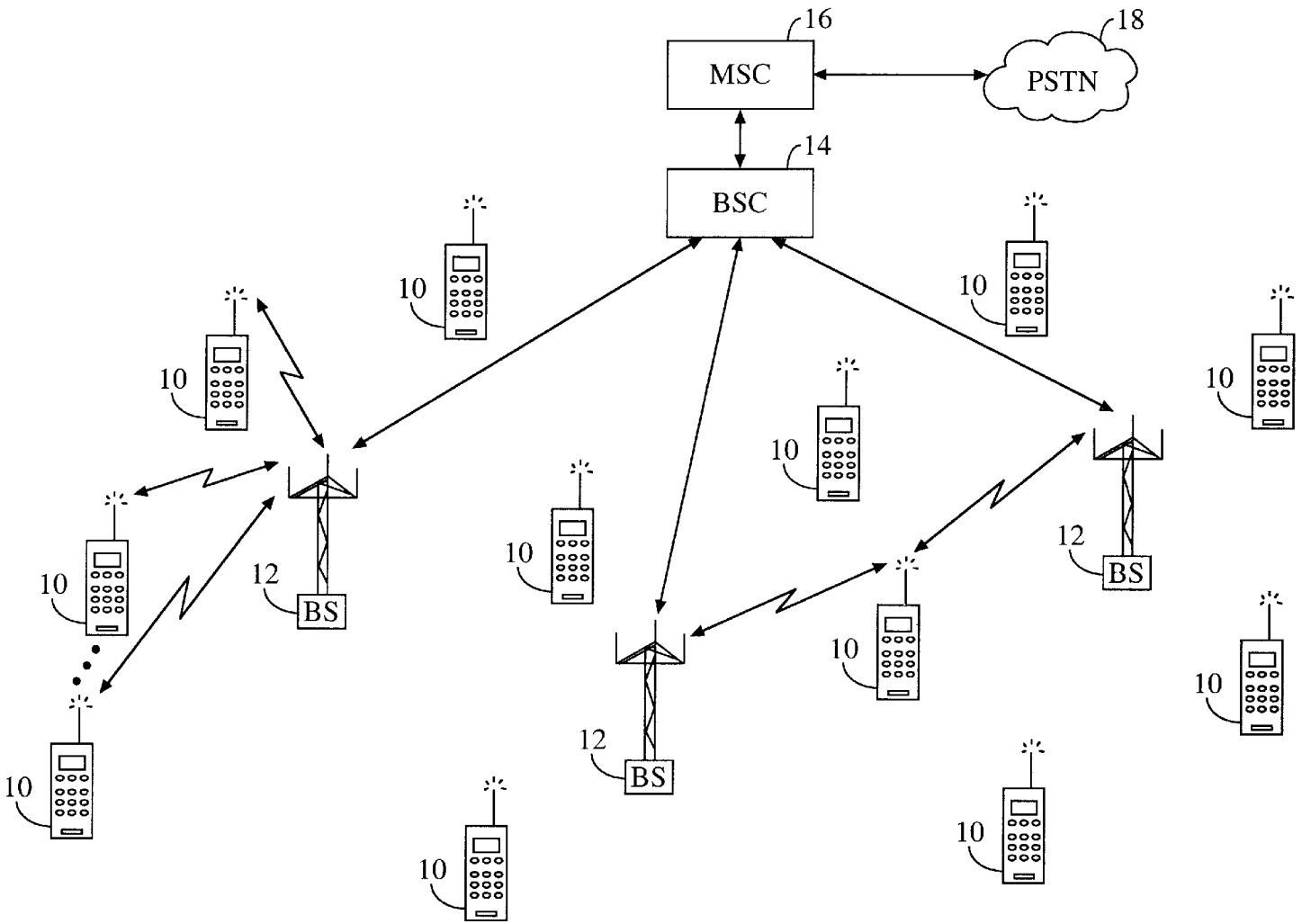
FIG. 1 is a block diagram of a wireless telephone system.

As illustrated in FIG. 1, a CDMA wireless telephone system generally includes a plurality of mobile subscriber units 10, a plurality of base stations 12, base station controllers (BSCs) 14, and a mobile switching center (MSC) 16. The MSC 16 is configured to interface with a conventional public switch telephone network (PSTN) 18. The MSC 16 is also configured to interface with the BSCs 14. The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL. It is understood that there may be more than two BSCs 14 in the system. Each base station 12 advantageously includes at least one sector (not shown), each sector comprising an omnidirectional antenna or an antenna pointed in a particular direction radially away from the base station 12. Alternatively, each sector may comprise two antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The mobile subscriber units 10 are typically cellular or PCS telephones 10. The system is advantageously configured for use in accordance with the IS-95 standard.

During typical operation of the cellular telephone system, the base stations 12 receive sets of reverse link signals from sets of mobile units 10. The mobile units 10 are conducting telephone calls or other communications. Each reverse link signal received by a given base station 12 is processed within that base station 12. The resulting data is forwarded to the BSCs 14. The BSCs 14 provides call resource allocation and mobility management functionality including the orchestration of soft handoffs between base stations 12. The BSCs 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile units 10.

Figure 2:
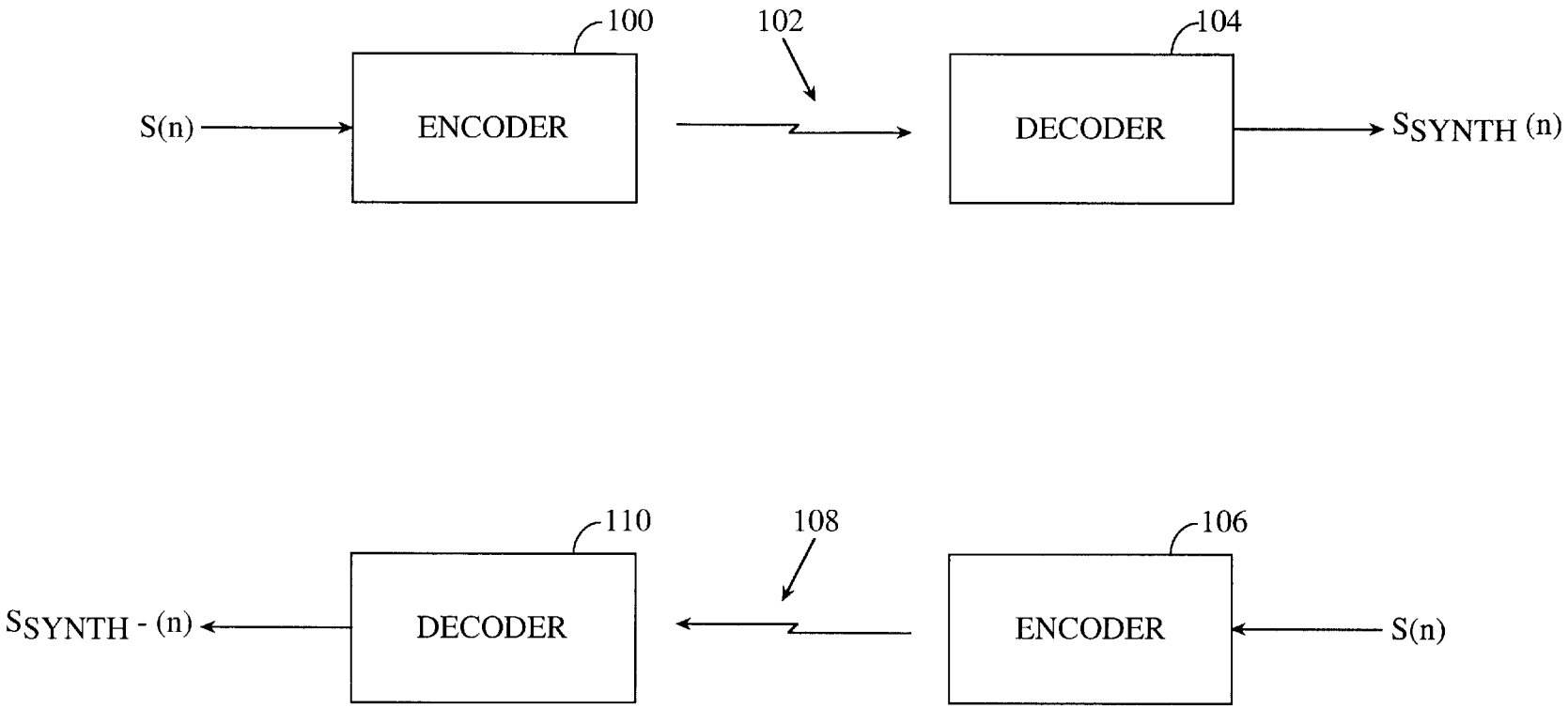
FIG. 2 is a block diagram of a communication channel terminated at each end by speech coders.

In FIG. 2 a first encoder 100 receives digitized speech samples s(n) and encodes the samples s(n) for transmission on a transmission medium 102, or communication channel 102, to a first decoder 104. The decoder 104 decodes the encoded speech samples and synthesizes an output speech signal $s_{SYNTH}(n)$. For transmission in the opposite direction, a second encoder 106 encodes digitized speech samples s(n), which are transmitted on a communication channel 108. A second decoder 110 receives and decodes the encoded speech samples, generating a synthesized output speech signal $s_{SYNTH}(n)$.

The speech samples s(n) represent speech signals that have been digitized and quantized in accordance with any of various methods known in the art including, e.g., pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 13.2 kbps (full rate) to 6.2 kbps (half rate) to 2.6 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 100 and the second decoder 110 together comprise a first speech coder, or speech codec. The speech coder could be used in any communication device for transmitting speech signals, including, e.g., the subscriber units, BTSs, or BSCs described above with reference to FIG. 1. Similarly, the second encoder 106 and the first decoder 104 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. Pat. No. 5,784,532, entitled VOCODER ASIC, filed Feb. 16, 1994, assigned to the assignee of the present invention, and fully incorporated herein by reference.

Figure 3:
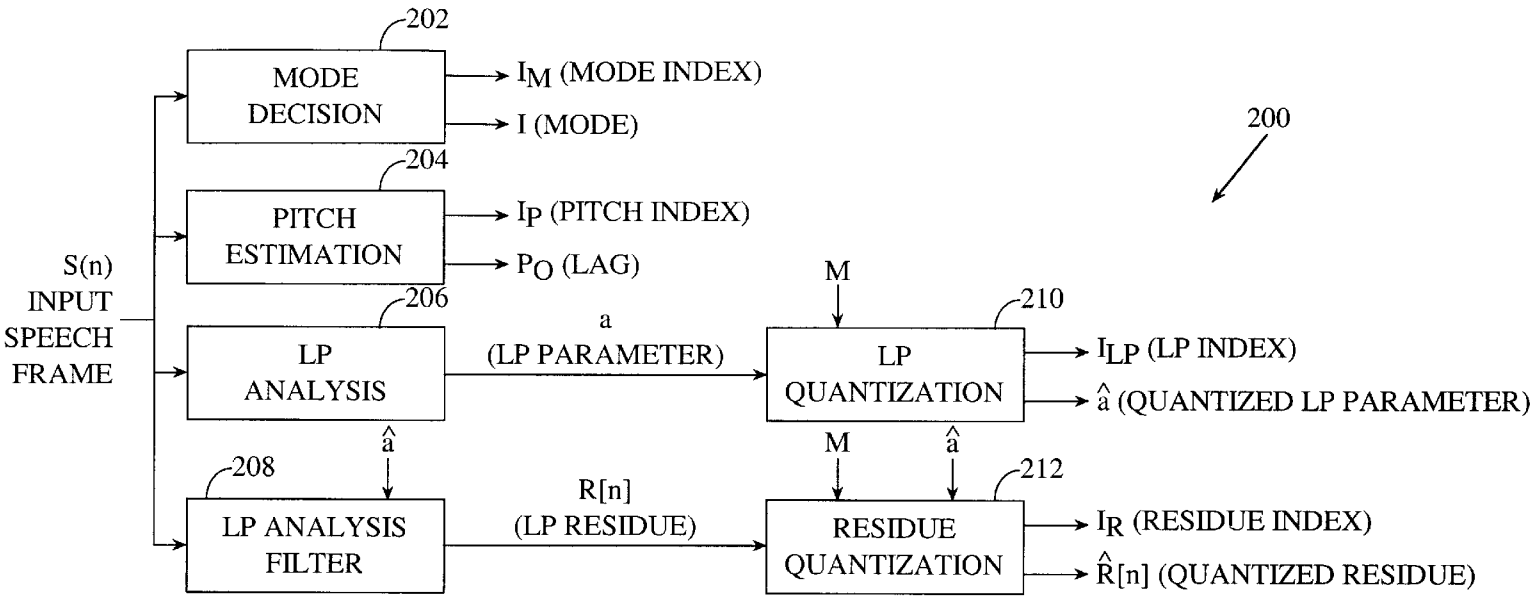
FIG. 3 is a block diagram of an encoder.

In FIG. 3 an encoder 200 that may be used in a speech coder includes a mode decision module 202, a pitch estimation module 204, an LP analysis module 206, an LP analysis filter 208, an LP quantization module 210, and a residue quantization module 212. Input speech frames s(n) are provided to the mode decision module 202, the pitch estimation module 204, the LP analysis module 206, and the LP analysis filter 208. The mode decision module 202 produces a mode index $I_M$ and a mode M based upon the periodicity, energy, signal-to-noise ratio (SNR), or zero crossing rate, among other features, of each input speech frame s(n). Various methods of classifying speech frames according to periodicity are described in U.S. Pat. No. 5,911,128, which is assigned to the assignee of the present invention and fully incorporated herein by reference. Such methods are also incorporated into the Telecommunication Industry Association Industry Interim Standards TIA/EIA IS-127 and TIA/EIA IS-733. An exemplary mode decision scheme is also described in the aforementioned U.S. application Ser. No. 09/217,341.

The pitch estimation module 204 produces a pitch index $I_P$ and a lag value $P_0$ based upon each input speech frame s(n). The LP analysis module 206 performs linear predictive analysis on each input speech frame s(n) to generate an LP parameter a. The LP parameter a is provided to the LP quantization module 210. The LP quantization module 210 also receives the mode M, thereby performing the quantization process in a mode-dependent manner. The LP quantization module 210 produces an LP index $I_{LP}$ and a quantized LP parameter â. The LP analysis filter 208 receives the quantized LP parameter â in addition to the input speech frame s(n). The LP analysis filter 208 generates an LP residue signal R[n], which represents the error between the input speech frames s(n) and the reconstructed speech based on the quantized linear predicted parameters â. The LP residue R[n], the mode M, and the quantized LP parameter â are provided to the residue quantization module 212. Based upon these values, the residue quantization module 212 produces a residue index $I_R$ and a quantized residue signal $\hat{R}[n]$.

Figure 4:
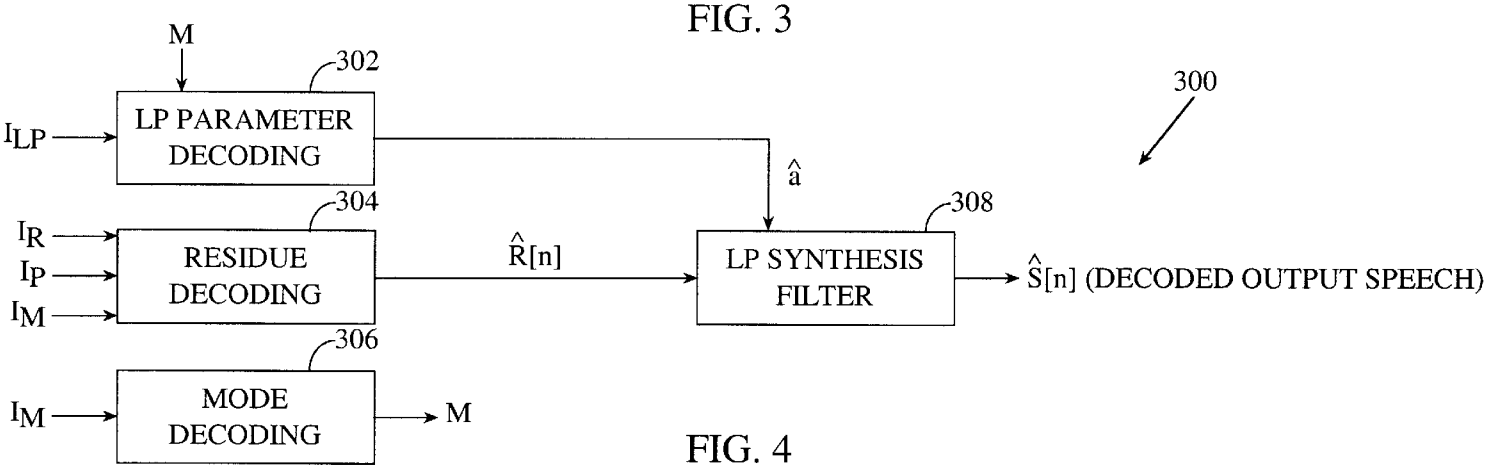
FIG. 4 is a block diagram of a decoder.

In FIG. 4 a decoder 300 that may be used in a speech coder includes an LP parameter decoding module 302, a residue decoding module 304, a mode decoding module 306, and an LP synthesis filter 308. The mode decoding module 306 receives and decodes a mode index $I_M$, generating therefrom a mode M. The LP parameter decoding module 302 receives the mode M and an LP index $I_{LP}$. The LP parameter decoding module 302 decodes the received values to produce a quantized LP parameter â. The residue decoding module 304 receives a residue index $I_R$, a pitch index $I_P$, and the mode index $I_M$. The residue decoding module 304 decodes the received values to generate a quantized residue signal $\hat{R}[n]$. The quantized residue signal $\hat{R}[n]$ and the quantized LP parameter â are provided to the LP synthesis filter 308, which synthesizes a decoded output speech signal $\hat{s}[n]$ therefrom.

Operation and implementation of the various modules of the encoder 200 of FIG. 3 and the decoder 300 of FIG. 4 are known in the art and described in the aforementioned U.S. Pat. No. 5,414,796 and L. B. Rabiner & R. W. Schafer, *Digital Processing of Speech Signals* 396–453 (1978).

Figure 5:
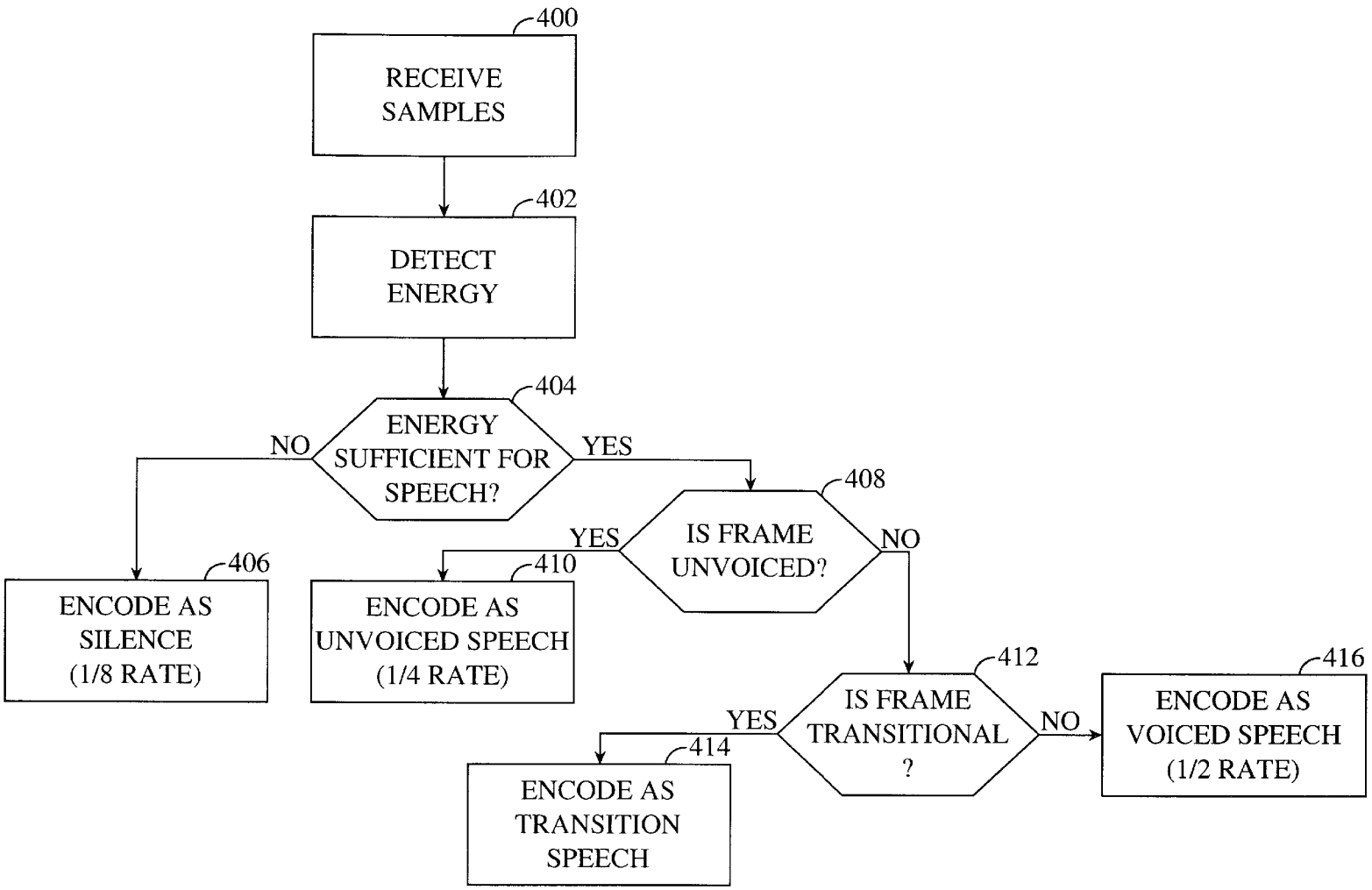
FIG. 5 is a flow chart illustrating a speech coding decision process.

As illustrated in the flow chart of FIG. 5, a speech coder in accordance with one embodiment follows a set of steps in processing speech samples for transmission. In step 400 the speech coder receives digital samples of a speech signal in successive frames. Upon receiving a given frame, the speech coder proceeds to step 402. In step 402 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 404. In step 404 the speech coder determines whether the detected frame energy is sufficient to classify the frame as containing speech information. If the detected frame energy falls below a predefined threshold level, the speech coder proceeds to step 406. In step 406 the speech coder encodes the frame as background noise (i.e., nonspeech, or silence). In one embodiment the background noise frame is encoded at ⅛ rate, or 1 kbps. If in step 404 the detected frame energy meets or exceeds the predefined threshold level, the frame is classified as speech and the speech coder proceeds to step 408.

In step 408 the speech coder determines whether the frame is unvoiced speech, i.e., the speech coder examines the periodicity of the frame. Various known methods of periodicity determination include, e.g., the use of zero crossings and the use of normalized autocorrelation functions (NACFs). In particular, using zero crossings and NACFs to detect periodicity is described in the aforementioned U.S. Pat. No. 5,911,128 and U.S. application Ser. No. 09/217,341. In addition, the above methods used to distinguish voiced speech from unvoiced speech are incorporated into the Telecommunication Industry Association Interim Standards TIA/EIA IS-127 and TIA/EIA IS-733. If the frame is determined to be unvoiced speech in step 408, the speech coder proceeds to step 410. In step 410 the speech coder encodes the frame as unvoiced speech. In one embodiment unvoiced speech frames are encoded at quarter rate, or 2.6 kbps. If in step 408 the frame is not determined to be unvoiced speech, the speech coder proceeds to step 412.

In step 412 the speech coder determines whether the frame is transitional speech, using periodicity detection methods that are known in the art, as described in, e.g., the aforementioned U.S. Pat. No. 5,911,128. If the frame is determined to be transitional speech, the speech coder proceeds to step 414. In step 414 the frame is encoded as transition speech (i.e., transition from unvoiced speech to voiced speech). In one embodiment the transition speech frame is encoded in accordance with a multipulse interpolative coding method described in U.S. Pat. No. 6,260,017, entitled MULTIPULSE INTERPOLATIVE CODING OF TRANSITION SPEECH FRAMES, filed May 7, 1999, assigned to the assignee of the present invention, and fully incorporated herein by reference. In another embodiment the transition speech frame is encoded at full rate, or 13.2 kbps.

If in step 412 the speech coder determines that the frame is not transitional speech, the speech coder proceeds to step 416. In step 416 the speech coder encodes the frame as voiced speech. In one embodiment voiced speech frames may be encoded at half rate, or 6.2 kbps. It is also possible to encode voiced speech frames at full rate, or 13.2 kbps (or full rate, 8 kbps, in an 8k CELP coder). Those skilled in the art would appreciate, however, that coding voiced frames at half rate allows the coder to save valuable bandwidth by exploiting the steady-state nature of voiced frames. Further, regardless of the rate used to encode the voiced speech, the voiced speech is advantageously coded using information from past frames, and is hence said to be coded predictively.

Those of skill would appreciate that either the speech signal or the corresponding LP residue may be encoded by following the steps shown in FIG.

Figure 6A:
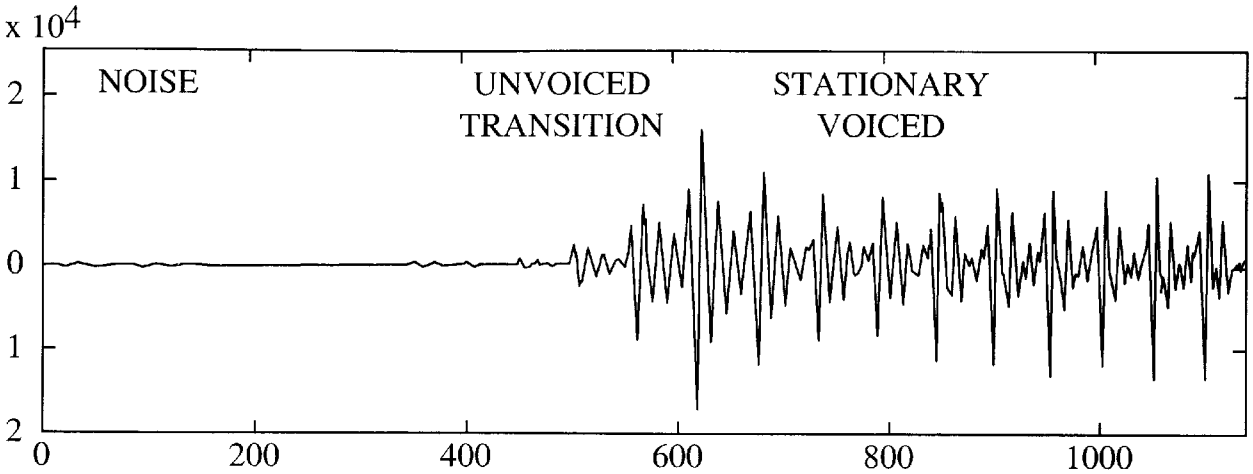
FIG. 6A is a graph speech signal amplitude versus time.
Figure 6B:
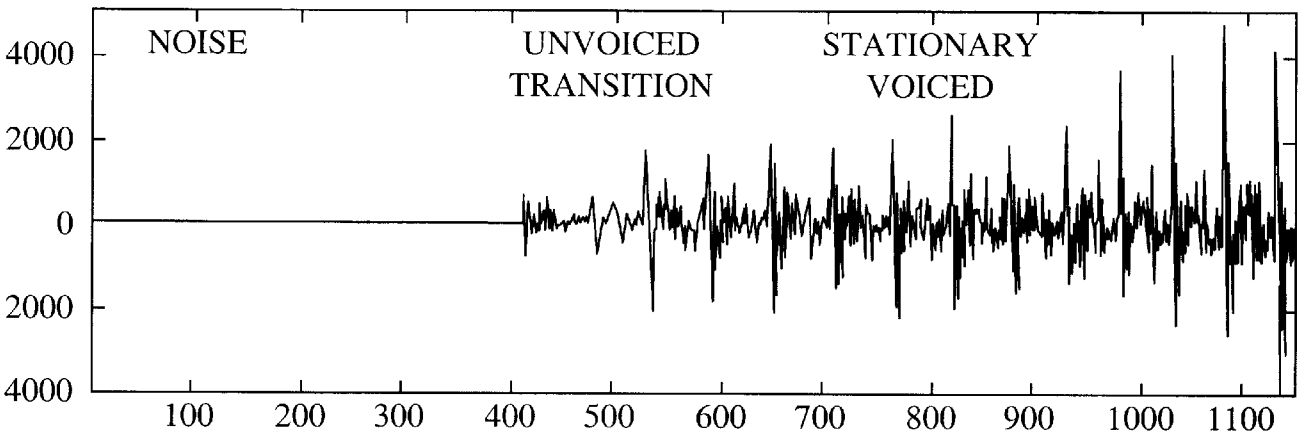
FIG. 6B is a graph of linear prediction (LP) residue amplitude versus time.

The waveform characteristics of noise, unvoiced, transition, and voiced speech can be seen as a function of time in the graph of FIG. 6A. The waveform characteristics of noise, unvoiced, transition, and voiced LP residue can be seen as a function of time in the graph of FIG. 6B.

Figure 7:
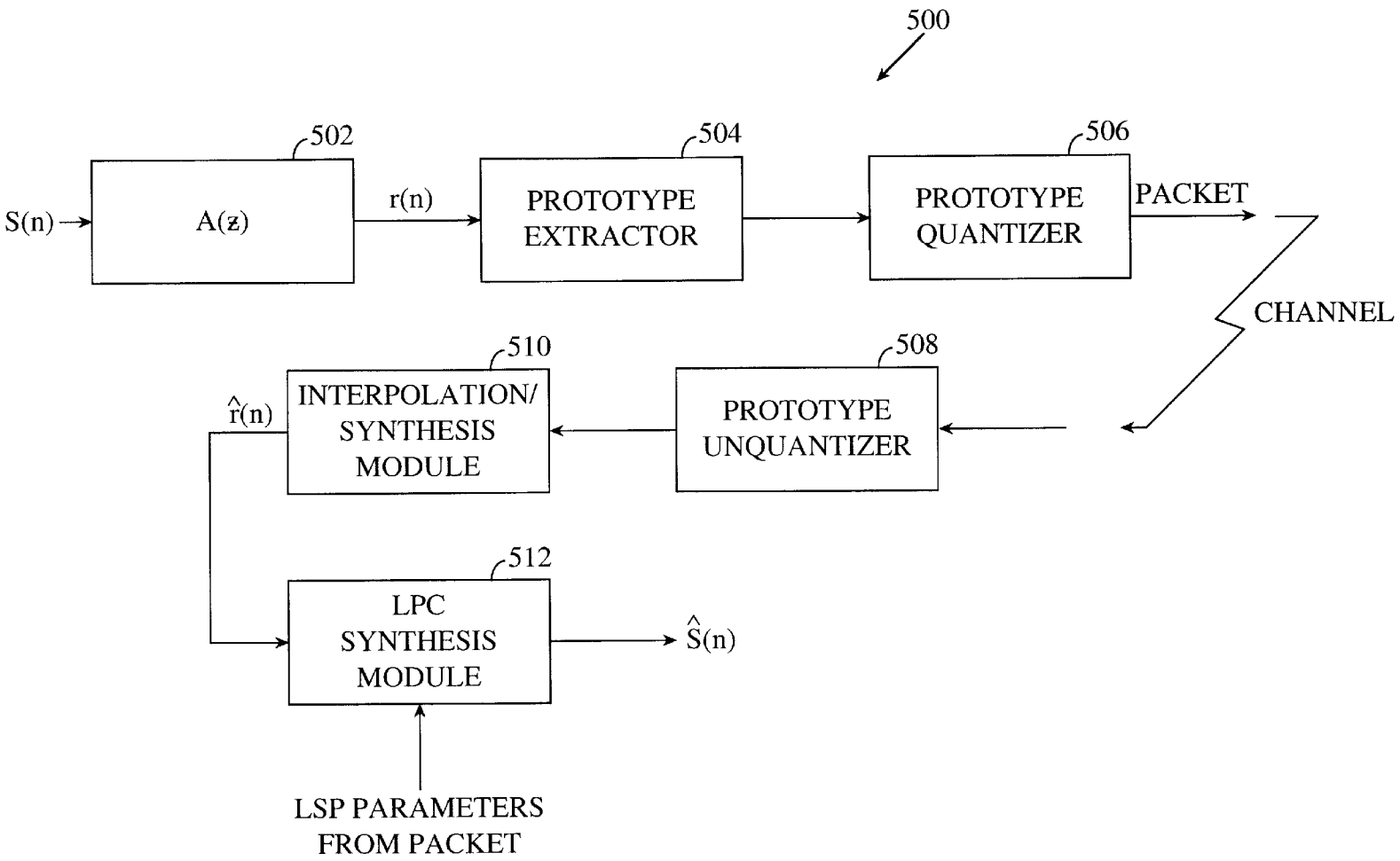
FIG. 7 is a block diagram of a prototype pitch period speech coder.

In one embodiment a prototype pitch period (PPP) speech coder 500 includes an inverse filter 502, a prototype extractor 504, a prototype quantizer 506, a prototype unquantizer 508, an interpolation/synthesis module 510, and an LPC synthesis module 512, as illustrated in FIG. 7. The speech coder 500 may advantageously be implemented as part of a DSP, and may reside in, e.g., a subscriber unit or base station in a PCS or cellular telephone system, or in a subscriber unit or gateway in a satellite system.

In the speech coder 500, a digitized speech signal s(n), where n is the frame number, is provided to the inverse LP filter 502. In a particular embodiment, the frame length is twenty ms. The transfer function of the inverse filter A(z) is computed in accordance with the following equation:

$$A(z)=1-a_1z^{-1}-a_2z^{-2}- \ldots -a_pz^{-p},$$

where the coefficients $a_1$ are filter taps having predefined values chosen in accordance with known methods, as described in the aforementioned U.S. Pat. No. 5,414,796 and U.S. application Ser. No. 09/217,494, both previously fully incorporated herein by reference. The number p indicates the number of previous samples the inverse LP filter 502 uses for prediction purposes. In a particular embodiment, p is set to ten.

The inverse filter 502 provides an LP residual signal r(n) to the prototype extractor 504. The prototype extractor 504 extracts a prototype from the current frame. The prototype is a portion of the current frame that will be linearly interpolated by the interpolation/synthesis module 510 with prototypes from previous frames that were similarly positioned within the frame in order to reconstruct the LP residual signal at the decoder.

The prototype extractor 504 provides the prototype to the prototype quantizer 506, which quantizes the prototype in accordance with a technique described below with reference to FIG. 8. The quantized values, which may be obtained from a lookup table (not shown), are assembled into a packet, which includes lag and other codebook parameters, for transmission over the channel. The packet is provided to a transmitter (not shown) and transmitted over the channel to a receiver (also not shown). The inverse LP filter 502, the prototype extractor 504, and the prototype quantizer 506 are said to have performed PPP analysis on the current frame.

The receiver receives the packet and provides the packet to the prototype unquantizer 508. The prototype unquantizer 508 unquantizes the packet in accordance with a technique described below with reference to FIG. 9. The prototype unquantizer 508 provides the unquantized prototype to the interpolation/synthesis module 510. The interpolation/synthesis module 510 interpolates the prototype with prototypes from previous frames that were similarly positioned within the frame in order to reconstruct the LP residual signal for the current frame. The interpolation and frame synthesis is advantageously accomplished in accordance with known methods described in U.S. Pat. No. 5,884,253 and in the aforementioned U.S. application Ser. No. 09/217,494.

The interpolation/synthesis module 510 provides the reconstructed LP residual signal $\hat{r}(n)$ to the LPC synthesis module 512. The LPC synthesis module 512 also receives line spectral pair (LSP) values from the transmitted packet, which are used to perform LPC filtration on the reconstructed LP residual signal $\hat{r}(n)$ to create the reconstructed speech signal $\hat{s}(n)$ for the current frame. In an alternate embodiment, LPC synthesis of the speech signal (n) may be performed for the prototype prior to doing interpolation/synthesis of the current frame. The prototype unquantizer 508, the interpolation/synthesis module 510, and the LPC synthesis module 512 are said to have performed PPP synthesis of the current frame.

Figure 8:
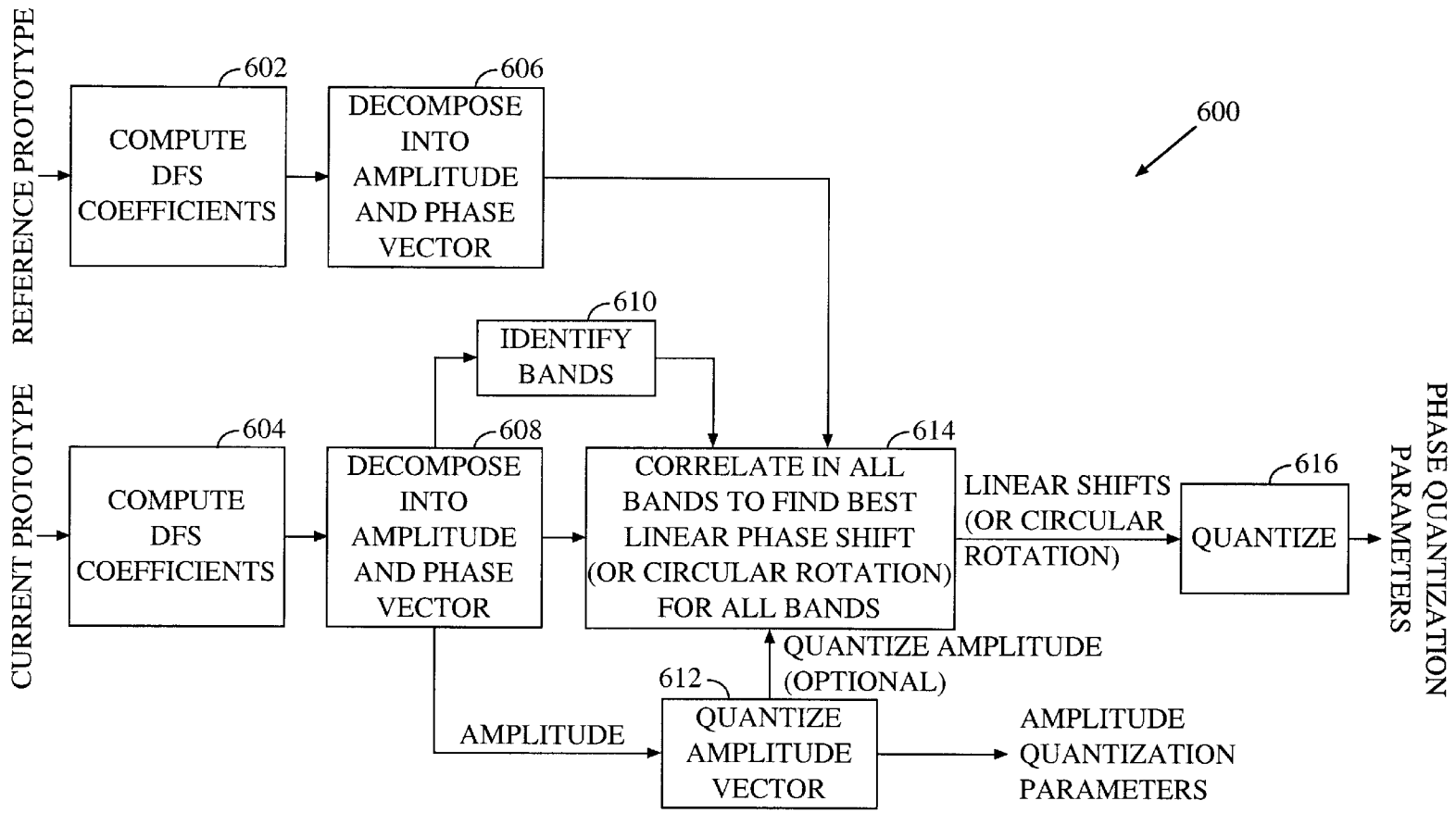
FIG. 8 is a block diagram of a prototype quantizer that may be used in the speech coder of FIG. 7.

In one embodiment a prototype quantizer 600 performs quantization of prototype phases using intelligent subsampling for efficient transmission, as shown in FIG. 8. The prototype quantizer 600 includes first and second discrete Fourier series (DFS) coefficient computation modules 602, 604, first and second decomposition modules 606, 608, a band identification module 610, an amplitude vector quantizer 612, a correlation module 614, and a quantizer 616.

In the prototype quantizer 600, a reference prototype is provided to the first DFS coefficient computation module 602. The first DFS coefficient computation module 602 computes the DFS coefficients for the reference prototype, as described below, and provides the DFS coefficients for the reference prototype to the first decomposition module 606. The first decomposition module 606 decomposes the DFS coefficients for the reference prototype into amplitude and phase vectors, as described below. The first decomposition module 606 provides the amplitude and phase vectors to the correlation module 614.

The current prototype is provided to the second DFS coefficient computation module 602. The second DFS coefficient computation module 606 computes the DFS coefficients for the current prototype, as described below, and provides the DFS coefficients for the current prototype to the second decomposition module 608. The second decomposition module 608 decomposes the DFS coefficients for the current prototype into amplitude and phase vectors, as described below. The second decomposition module 608 provides the amplitude and phase vectors to the correlation module 614.

The second decomposition module 608 also provides the amplitude and phase vectors for the current prototype to the band identification module 610. The band identification module 610 identifies frequency bands for correlation, as described below, and provides band identification indices to the correlation module 614.

The second decomposition module 608 also provides the amplitude vector for the current prototype to the amplitude vector quantizer 612. The amplitude vector quantizer 612 quantizes the amplitude vector for the current prototype, as described below, and generates amplitude quantization parameters for transmission. In a particular embodiment, the amplitude vector quantizer 612 provides quantized amplitude values to the band identification module 610 (this connection is not shown in the drawing for the purpose of clarity) and/or to the correlation module 614.

The correlation module 614 correlates in all frequency bands to determine the optimal linear phase shift for all bands, as described below. In an alternate embodiment, cross-correlation is performed in the time domain on the bandpass signal to determine the optimal circular rotation for all bands, also as described below. The correlation module 614 provides linear phase shift values to the quantizer 616. In an alternate embodiment, the correlation module 614 provides circular rotation values to the quantizer 616. The quantizer 616 quantizes the received values, as described below, generating phase quantization parameters for transmission.

Figure 9:
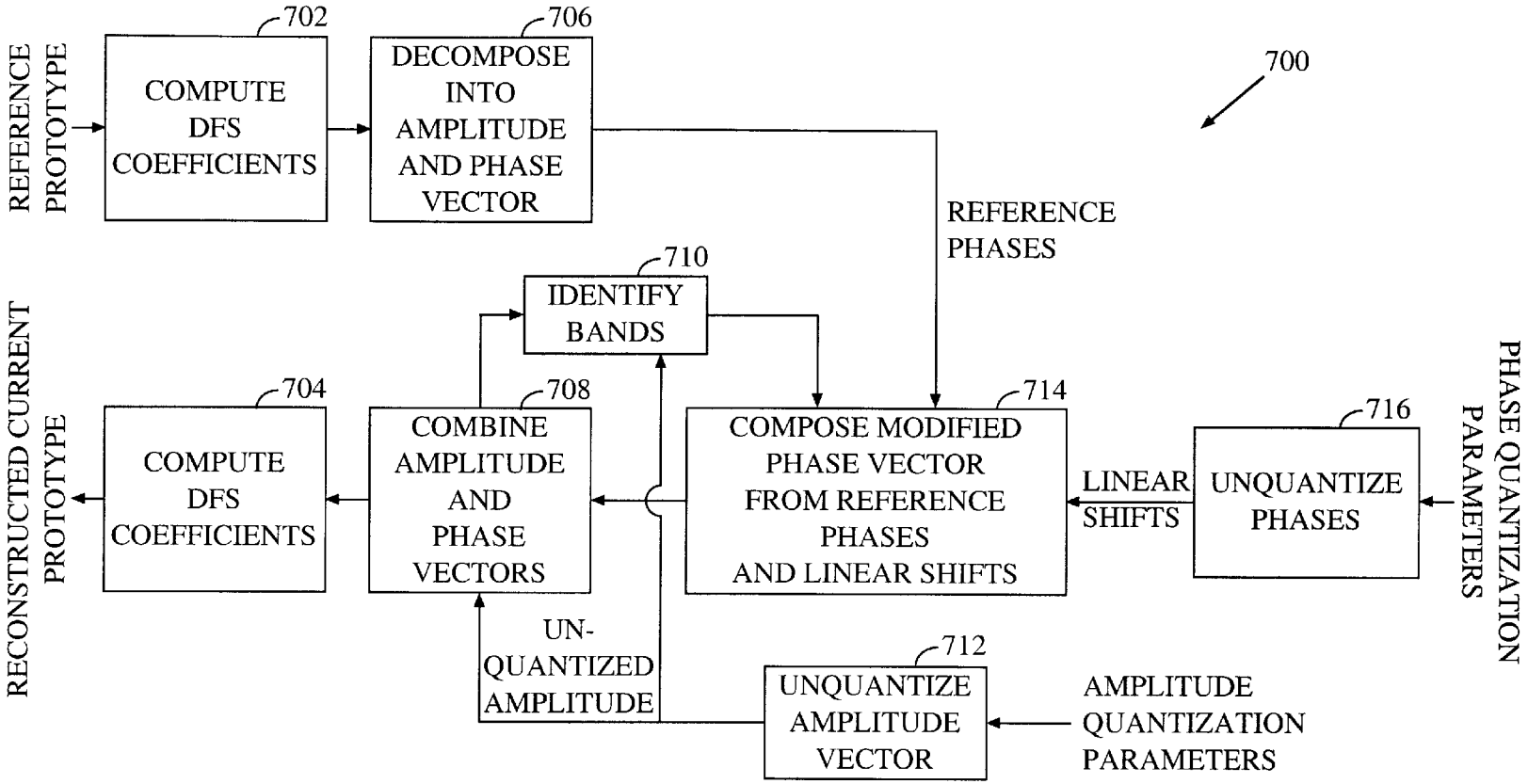
FIG. 9 is a block diagram of a prototype unquantizer that may be used in the speech coder of FIG. 7.

In one embodiment a prototype unquantizer 700 performs reconstruction of the prototype phase spectrum using linear shifts on constituent frequency bands of a DFS, as shown in FIG. 9. The prototype unquantizer 700 includes a DFS coefficient computation module 702, an inverse DFS computation module 704, a decomposition module 706, a combination module 708, a band identification module 710, an amplitude vector unquantizer 712, a composition module 714, and a phase unquantizer 716.

In the prototype unquantizer 700, a reference prototype is provided to the DFS coefficient computation module 702. The DFS coefficient computation module 702 computes the DFS coefficients for the reference prototype, as described below, and provides the DFS coefficients for the reference prototype to the decomposition module 706. The decomposition module 706 decomposes the DFS coefficients for the reference prototype into amplitude and phase vectors, as described below. The decomposition module 706 provides reference phases (i.e., the phase vector of the reference prototype) to the composition module 714.

Phase quantization parameters are received by the phase unquantizer 716. The phase unquantizer 716 unquantizes the received phase quantization parameters, as described below, generating linear phase shift values. The phase unquantizer 716 provides the linear phase shift values to the composition module 714.

Amplitude vector quantization parameters are received by the amplitude vector unquantizer 712. The amplitude vector unquantizer 712 unquantizes the received amplitude quantization parameters, as described below, generating unquantized amplitude values. The amplitude vector unquantizer 712 provides the unquantized amplitude values to the combination module 708. The amplitude vector unquantizer 712 also provides the unquantized amplitude values to the band identification module 710. The band identification module 710 identifies frequency bands for combination, as described below, and provides band identification indices to the composition module 714.

The composition module 714 composes a modified phase vector from the reference phases and the linear phase shift values, as described below. The composition module 714 provides modified phase vector values to the combination module 708.

The combination module 708 combines the unquantized amplitude values and the phase values, as described below, generating a reconstructed, modified DFS coefficient vector. The combination module 708 provides the combined amplitude and phase vectors to the inverse DFS computation module 704. The inverse DFS computation module 704 computes the inverse DFS of the reconstructed, modified DFS coefficient vector, as described below, generating the reconstructed current prototype.

In one embodiment a prototype unquantizer 800 performs reconstruction of the prototype phase spectrum using circular rotations performed in the time domain on the constituent bandpass waveforms of the prototype waveform at the encoder, as shown in FIG. 9. The prototype unquantizer 800 includes a DFS coefficient computation module 802, a bandpass waveform summer 804, a decomposition module 806, an inverse DFS/bandpass signal creation module 808, a band identification module 810, an amplitude vector unquantizer 812, a composition module 814, and a phase unquantizer 816.

In the prototype unquantizer 800, a reference prototype is provided to the DFS coefficient computation module 802. The DFS coefficient computation module 802 computes the DFS coefficients for the reference prototype, as described below, and provides the DFS coefficients for the reference prototype to the decomposition module 806. The decomposition module 806 decomposes the DFS coefficients for the reference prototype into amplitude and phase vectors, as described below. The decomposition module 806 provides reference phases (i.e., the phase vector of the reference prototype) to the composition module 814.

Phase quantization parameters are received by the phase unquantizer 816. The phase unquantizer 816 unquantizes the received phase quantization parameters, as described below, generating circular rotation values. The phase unquantizer 816 provides the circular rotation values to the composition module 814.

Amplitude vector quantization parameters are received by the amplitude vector unquantizer 812. The amplitude vector unquantizer 812 unquantizes the received amplitude quantization parameters, as described below, generating unquantized amplitude values. The amplitude vector unquantizer 812 provides the unquantized amplitude values to the inverse DFS/bandpass signal creation module 808. The amplitude vector unquantizer 812 also provides the unquantized amplitude values to the band identification module 810. The band identification module 810 identifies frequency bands for combination, as described below, and provides band identification indices to the inverse DFS/bandpass signal creation 808.

The inverse DFS/bandpass signal creation module 808 combines the unquantized amplitude values and the reference phase value for each of the bands, and computes a bandpass signal from the combination, using the inverse DFS for each of the bands, as described below. The inverse DFS/bandpass signal creation module 808 provides the bandpass signals to the composition module 814.

The composition module 814 circularly rotates each of the bandpass signals using the unquantized circular rotation values, as described below, generating modified, rotated bandpass signals. The composition module 814 provides the modified, rotated bandpass signals to the bandpass waveform summer 804. The bandpass waveform summer 804 adds all of the bandpass signals to generate the reconstructed prototype.

The prototype quantizer 600 and of FIG. 8 and the prototype unquantizer 700 of FIG. 9 serve in normal operation to encode and decode, respectively, phase spectrum of prototype pitch period waveforms. At the transmitter/encoder (FIG. 8), the phase spectrum, $\phi_k^c$, of the prototype, $s_C(n)$, of the current frame is computed using the DFS representation $$s_c(n) = \sum_k C_k^c e^{jnk(\omega_o^c)},$$

where $C_k^c$ are the complex DFS coefficients of the current prototype and $\omega_o^c$ is the normalized fundamental frequency of $s_C(n)$. The phase spectrum, $\phi_k^c$, is the angle of the complex coefficients constituting the DFS. The phase spectrum, $\phi_k^r$, of the reference prototype is computed in similar fashion to provide $C_k^r$ and $\phi_k^r$. Alternatively, the phase spectrum, $\phi_k^r$, of the reference prototype was stored after the frame having the reference prototype was processed, and is simply retrieved from storage. In a particular embodiment, the reference prototype is a prototype from the previous frame. The complex DFS for both the prototypes from both the reference frame and the current frame can be represented as the product of the amplitude spectra and the phase spectra, as shown in the following equation: $C_k^c = A_k^c e^{j\phi_k c}$. It should be noted that both the amplitude spectra and the phase spectra are vectors because the complex DFS is also a vector. Each element of the DFS vector is a harmonic of the frequency equal to the reciprocal of the time duration of the corresponding prototype. For a signal of maximum frequency of Fm Hz (sampled at a rate of at least of 2 Fm Hz) and a harmonic frequency of Fo Hz, there are M harmonics. The number of harmonics, M, is equal to Fm/Fo. Hence, the phase spectra vector and the amplitude spectra vector of each prototype consist of M elements.

The DFS vector of the current prototype is partitioned into B bands and the time signal corresponding to each of the B bands is a bandpass signal. The number of bands, B, is constrained to be less than the number of harmonics, M. Summing all of the B bandpass time signals would yield the original current prototype. In similary fashion, the DFS vector for the reference prototype is also partitioned into the same B bands.

Figure 10:
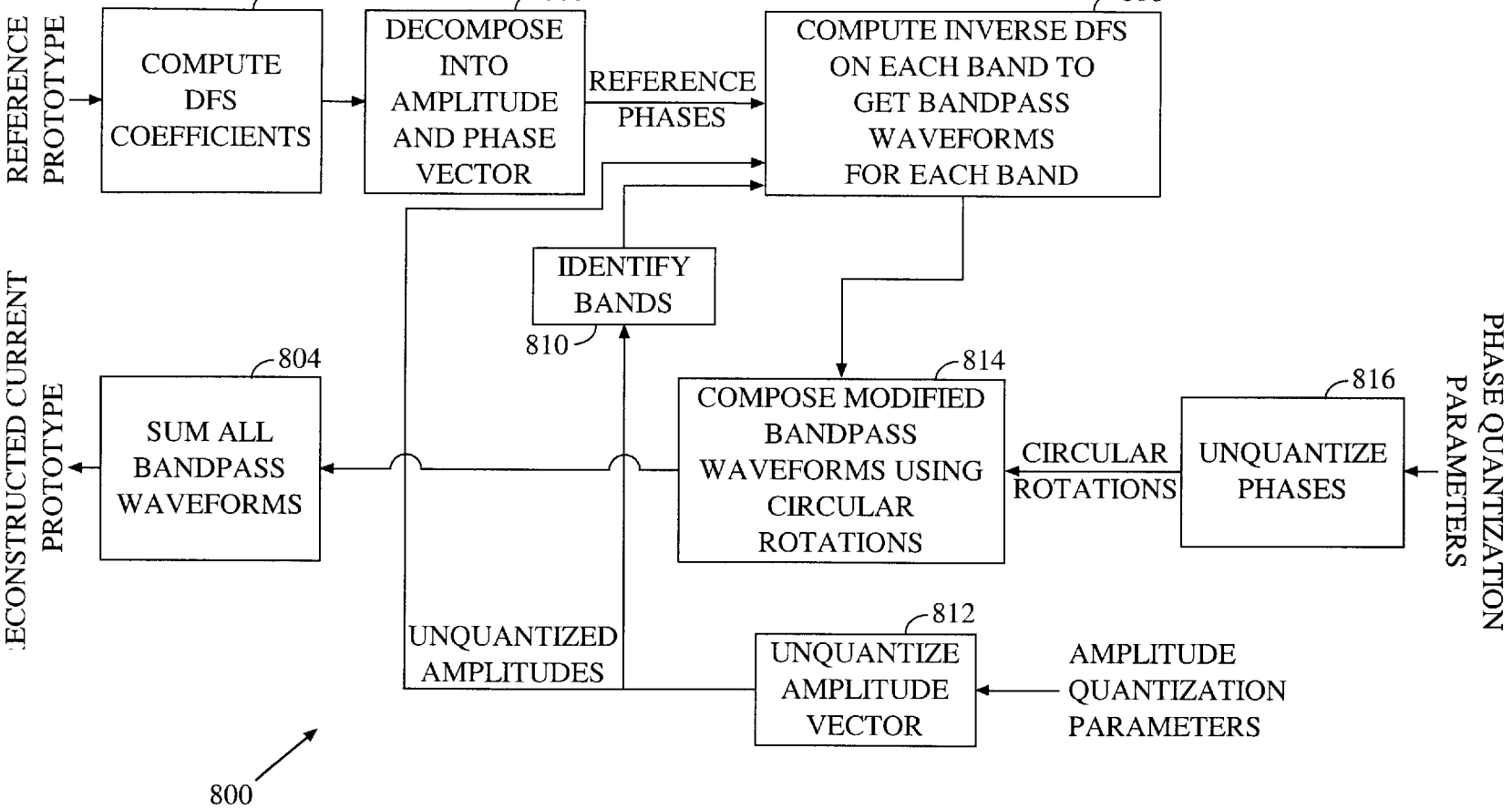
FIG. 10 is a block diagram of a prototype unquantizer that may be used in the speech coder of FIG. 7.

For each of the B bands, a cross-correlation is performed between the bandpass signal corresponding to the reference prototype and the bandpass signal corresponding to the current prototype. The cross-correlation can be performed on the frequency-domain DFS vectors, $$\gamma_{\theta_i} = \left(C^r_{\{k_{b_i}\}} e^{j\{k_{b_i}\}\theta_i}\right)^T \left(C^c_{\{k_{b_i}\}}\right),$$

where $\{k_{b_i}\}$ is the set of harmonic numbers in the $i^{th}$ band $b_i$, and $\theta_i$ is a possible linear phase shift for the $i^{th}$ band $b_i$. The cross-correlation may also be performed on the corresponding time-domain bandpass signals (for example, with the unquantizer 800 of FIG. 10) in accordance with the following equation:

$$\gamma_{r_i} = \sum_{n=0}^{L-1} \left[ \left( \sum_{\{k_{b_i}\}} C^r_{\{k_{b_i}\}} e^{j((n+r_i)\%L)\{k_{b_i}\}\varpi_o^r} \right) \left( \sum_{\{k_{b_i}\}} C^c_{\{k_{b_i}\}} e^{jn\{k_{b_i}\}\varpi_o^c} \right) \right],$$

where L is the length in samples of the current prototype, $\omega_o^r$ and $\omega_o^c$ are the normalized fundamental frequencies of the reference prototype and the current prototype, respectively, and $r_i$ is the circular rotation in samples. The bandpass time-domain signals $s_{b_i}^r(n)$ and $S_{b_i}^c(n)$ corresponding to the band $b_I$ are given by, respectively, the following expressions:

$$\sum_{n=0}^{L-1} \left[ \sum_{\{k_{b_i}\}} C^r_{\{k_{b_i}\}} e^{jn\{k_{b_i}\}\varpi_o^r} \right] \text{ and } \sum_{n=0}^{L-1} \left[ \sum_{\{k_{b_i}\}} C^c_{\{k_{b_i}\}} e^{jn\{k_{b_i}\}\varpi_o^c} \right].$$

In one embodiment the quantized amplitude vector, $\hat{A}_k^c$, is used to get $C_k^c$, as shown in the following equation: $C_k^c = \hat{A}_k^c e^{j\phi_k c}$. The cross-correlation is performed over all possible linear phase shifts of the bandpass DFS vector of the reference prototype. Alternatively, the cross-correlation may be performed over a subset of all possible linear phase shifts of the bandpass DFS vector of the reference prototype. In an alternate embodiment, a time-domain approach is employed, and the cross-correlation is performed over all possible circular rotations of bandpass time signals of the reference prototype. In one embodiment the cross-correlation is performed over a subset of all possible circular rotations of bandpass time signal of the reference prototype. The cross-correlation process generates B linear phase shifts (or B circular rotations, in the embodiment wherein cross-correlation is performed in the time domain on the bandpass time signal) that correspond to maximum values of the cross-correlation for each of the B bands. The B linear phase shifts (or, in the alternate embodiment, the B circular rotations) are then quantized and transmitted as representatives of the phase spectra in place of the M original phase spectra vector elements. The amplitude spectra vector is separately quantized and transmitted. Thus, the bandpass DFS vectors (or the bandpass time signals) of the reference prototype advantageously serve as codebooks to encode the corresponding DFS vectors (or the bandpass signals) of the prototype of the current frame. Accordingly, fewer elements are needed to quantize and transmit the phase information, thereby effecting a resulting subsampling of phase information and giving rise to more efficient transmission. This is particularly beneficial in low-bit-rate speech coding, where due to lack of sufficient bits, either the phase information is quantized very poorly due to the large amount of phase elements or the phase information is not transmitted at all, each of which results in low quality. The embodiments described above allow low-bit-rate coders to maintain good voice quality because there are fewer elements to quantize.

At the receiver/decoder (FIG. 9) (and also at the encoder's copy of the decoder, as would be understood by those of skill in the art), the B linear phase shift values are applied to the decoder's copy of the DFS B-band-partitioned vector of the reference prototype to generate a modified prototype DFS phase vector:

$$\phi^{c}_{\{k_{b_i}\}} = \phi^{r}_{\{k_{b_i}\}} + \{k_{b_i}\}\theta_{b_i}.$$

The modified DFS vector is then obtained as the product of the received and decoded amplitude spectra vector and the modified prototype DFS phase vector. The reconstructed prototype is then constructed using an inverse-DFS operation on the modified DFS vector. In the alternate embodiment, wherein a time-domain approach is employed, the amplitude spectra vector for each of the B bands and the phase vector of the reference prototype for the same B bands are combined, and an inverse DFS operation is performed on the combination to generate B bandpass time signals. The B A bandpass time signals are then circularly rotated using the B circular rotation values. All of the B bandpass time signals are added to generate the reconstructed prototype.

Thus, a novel method and apparatus for subsampling phase spectrum information has been described. Those of skill in the art would understand that the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, e.g., registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A method of processing a prototype of a frame in a speech coder, comprising the steps of:

producing a plurality of phase parameters of a reference prototype;

generating a plurality of phase parameters of the prototype; and correlating the phase parameters of the prototype with the phase parameters of the reference prototype in a plurality of frequency bands, wherein the correlating step generates a plurality of optimal circular rotation values for the prototype.

2. The method of claim 1, wherein the producing step comprises the steps of computing discrete Fourier series coefficients for the reference prototype and decomposing the discrete Fourier series coefficients into amplitude vectors and phase vectors for the reference prototype, and wherein the generating step comprises the steps of computing discrete Fourier series coefficients for the prototype and decomposing the discrete Fourier series coefficients into amplitude vectors and phase vectors for the prototype.

3. The method of claim 1, further comprising the step of identifying the frequency bands in which to perform the correlating step.

4. The method of claim 1, wherein the frame is a speech frame.

5. The method of claim 1, wherein the frame is a frame of linear prediction residue.

6. The method of claim 1, wherein the correlating step generates a plurality of optimal linear phase shift values for the prototype.

7. The method of claim 6, further comprising the steps of quantizing the linear phase shift values and quantizing a plurality of amplitude parameters for the prototype.

8. The method of claim 1, further comprising the steps of quantizing the circular rotation values and quantizing a plurality of amplitude parameters for the prototype.

9. A method of processing a prototype of a frame in a speech coder, comprising the steps of:

producing a plurality of phase parameters of a reference prototype;

generating a plurality of linear phase shift values associated with the prototype; and composing a phase vector from the phase parameters and the linear phase shift values across a plurality of frequency bands.

10. The method of claim 9, wherein the producing step comprises the steps of computing discrete Fourier series coefficients for the reference prototype and decomposing the discrete Fourier series coefficients into amplitude vectors and phase vectors for the reference prototype.

11. The method of claim 9, further comprising the step of identifying the frequency bands in which to perform the composing step.

12. The method of claim 9, wherein the frame is a speech frame.

13. The method of claim 9, wherein the frame is a frame of linear prediction residue.

14. The method of claim 9, wherein the generating step comprises unquantizing a plurality of quantized phase parameters associated with the prototype to generate the plurality of linear phase shift values.

15. The method of claim 11, further comprising the step of unquantizing a plurality of amplitude quantization parameters associated with the prototype to produce a plurality of unquantized amplitude parameters, wherein the identifying step comprises identifying bands based upon the plurality of unquantized amplitude parameters.

16. The method of claim 9, further comprising the steps of combining the composed phase vector with a plurality of amplitude parameters associated with the prototype to produce a combined vector, and computing an inverse discrete Fourier series of the combined vector to produce a reconstructed version of the prototype.

17. A method of processing a prototype of a frame in a speech coder, comprising the steps of:

producing a plurality of circular rotation values associated with the prototype;

generating a plurality of bandpass waveforms in a plurality of frequency bands, the plurality of bandpass waveforms being associated with a plurality of phase parameters of a reference prototype; and modifying the plurality of bandpass waveforms based upon the plurality of circular rotation values.

18. The method of claim 17, further comprising the step of identifying the frequency bands in which to perform the generating step.

19. The method of claim 17, wherein the frame is a speech frame.

20. The method of claim 17, wherein the frame is a frame of linear prediction residue.

21. The method of claim 17, wherein the producing step comprises unquantizing a plurality of quantized phase parameters associated with the prototype to generate the plurality of circular rotation values.

22. The method of claim 18, further comprising the step of unquantizing a plurality of amplitude quantization parameters associated with the prototype to produce a plurality of unquantized amplitude parameters, wherein the identifying step comprises identifying bands based upon the plurality of unquantized amplitude parameters.

23. The method of claim 22, wherein the generating step comprises the steps of computing discrete Fourier series coefficients for the reference prototype, decomposing the discrete Fourier series coefficients into an amplitude vector and a phase vector for the reference prototype, combining the phase vector with the plurality of unquantized amplitude parameters, and calculating the inverse discrete Fourier series of the phase vector to generate the plurality of bandpass waveforms.

24. The method of claim 17, further comprising the step of summing the plurality of modified bandpass waveforms to produce a reconstructed version of the prototype.

25. A speech coder, comprising:

means for producing a plurality of phase parameters of a reference prototype of a frame;

means for generating a plurality of phase parameters of a current prototype of a current frame; and means for correlating the phase parameters of the current prototype with the phase parameters of the reference prototype in a plurality of frequency bands, wherein the means for correlating generates a plurality of optimal circular rotation values for the current prototype.

26. The speech coder of claim 25, wherein the means for producing comprises means for computing discrete Fourier series coefficients for the reference prototype and means for decomposing the discrete Fourier series coefficients into amplitude vectors and phase vectors for the reference prototype, and wherein the means for generating comprises means for computing discrete Fourier series coefficients for the current prototype and means for decomposing the discrete Fourier series coefficients into amplitude vectors and phase vectors for the current prototype.

27. The speech coder of claim 25, further comprising means for identifying the plurality of frequency bands.

28. The speech coder of claim 25, wherein the current frame is a speech frame.

29. The speech coder of claim 25, wherein the current frame is a frame of linear prediction residue.

30. The speech coder of claim 25, wherein the means for correlating generates a plurality of optimal linear phase shift values for the current prototype.

31. The speech coder of claim 30, further comprising means for quantizing the linear phase shift values and means for quantizing a plurality of amplitude parameters for the current prototype.

32. The speech coder of claim 25, further comprising means for quantizing the circular rotation values and means for quantizing a plurality of amplitude parameters for the current prototype.

33. The speech coder of claim 25, wherein the speech coder resides in a subscriber unit of a wireless communication system.

34. A speech coder, comprising:

means for producing a plurality of phase parameters of a reference prototype of a frame;

means for generating a plurality of linear phase shift values associated with a current prototype of a current frame; and means for composing a phase vector from the phase parameters and the linear phase shift values across a plurality of frequency bands.

35. The speech coder of claim 34, wherein the means for producing comprises means for computing discrete Fourier series coefficients for the reference prototype and means for decomposing the discrete Fourier series coefficients into amplitude vectors and phase vectors for the reference prototype.

36. The speech coder of claim 34, further comprising means for identifying the plurality of frequency bands.

37. The speech coder of claim 34, wherein the current frame is a speech frame.

38. The speech coder of claim 34, wherein the current frame is a frame of linear prediction residue.

39. The speech coder of claim 34, wherein the means for generating comprises means for unquantizing a plurality of quantized phase parameters associated with the current prototype to generate the plurality of linear phase shift values.

40. The speech coder of claim 36, further comprising means for unquantizing a plurality of amplitude quantization parameters associated with the current prototype to produce a plurality of unquantized amplitude parameters, wherein the means for identifying comprises means for identifying the plurality of bands based upon the plurality of unquantized amplitude parameters.

41. The speech coder of claim 34, further comprising means for combining the composed phase vector with a plurality of amplitude parameters associated with the current prototype to produce a combined vector, and means for computing an inverse discrete Fourier series of the combined vector to produce a reconstructed version of the current prototype.

42. The speech coder of claim 34, wherein the speech coder resides in a subscriber unit of a wireless communication system.

43. A speech coder, comprising:

means for producing a plurality of circular rotation values associated with a current prototype of a current frame;

means for generating a plurality of bandpass waveforms in a plurality of frequency bands, the plurality of bandpass waveforms being associated with a plurality of phase parameters of a reference prototype of a frame; and means for modifying the plurality of bandpass waveforms based upon the plurality of circular rotation values.

44. The speech coder of claim 43, further comprising means for identifying the plurality of frequency bands.

45. The speech coder of claim 43, wherein the current frame is a speech frame.

46. The speech coder of claim 43, wherein the current frame is a frame of linear prediction residue.

47. The speech coder of claim 43, wherein the means for producing comprises means for unquantizing a plurality of quantized phase parameters associated with the current prototype to generate the plurality of circular rotation values.

48. The speech coder of claim 44, further comprising means for unquantizing a plurality of amplitude quantization parameters associated with the current prototype to produce a plurality of unquantized amplitude parameters, wherein the means for identifying comprises means for identifying bands based upon the plurality of unquantized amplitude parameters.

49. The speech coder of claim 48, wherein the means for generating comprises means for computing discrete Fourier series coefficients for the reference prototype, means for decomposing the discrete Fourier series coefficients into an amplitude vector and a phase vector for the reference prototype, means for combining the phase vector with the plurality of unquantized amplitude parameters, and means for calculating the inverse discrete Fourier series of the phase vector to generate the plurality of bandpass waveforms.

50. The speech coder of claim 43, further comprising means for summing the plurality of modified bandpass waveforms to produce a reconstructed version of the current prototype.

51. The speech coder of claim 43, wherein the speech coder resides in a subscriber unit of a wireless communication system.

52. A speech coder, comprising:

a prototype extractor configured to extract a current prototype from a current frame being processed by the speech coder; and a prototype quantizer coupled to the prototype extractor and configured to produce a plurality of phase parameters of a reference prototype of a frame, generate a plurality of phase parameters of the current prototype, and correlate the phase parameters of the current prototype with the phase parameters of the reference prototype in a plurality of frequency bands, wherein the prototype quantizer is further configured to generate a plurality of optimal circular rotation values for the current prototype.

53. The speech coder of claim 52, wherein the prototype quantizer is further configured to compute discrete Fourier series coefficients for the reference prototype, decompose the discrete Fourier series coefficients into amplitude vectors and phase vectors for the reference prototype, compute discrete Fourier series coefficients for the current prototype, and decompose the discrete Fourier series coefficients into amplitude vectors and phase vectors for the current prototype.

54. The speech coder of claim 52, wherein the prototype quantizer is further configured to identify the plurality of frequency bands.

55. The speech coder of claim 52, wherein the current frame is a speech frame.

56. The speech coder of claim 52, wherein the current frame is a frame of linear prediction residue.

57. The speech coder of claim 52, wherein the prototype quantizer is further configured to generate a plurality of optimal linear phase shift values for the current prototype.

58. The speech coder of claim 57, wherein the prototype quantizer is further configured to quantize the linear phase shift values and quantize a plurality of amplitude parameters for the current prototype.

59. The speech coder of claim 52, wherein the prototype quantizer is further configured to quantize the circular rotation values and quantize a plurality of amplitude parameters for the current prototype.

60. The speech coder of claim 52, wherein the speech coder resides in a subscriber unit of a wireless communication system.

61. A speech coder, comprising:

a prototype extractor configured to extract a current prototype from a current frame being processed by the speech coder; and a prototype quantizer coupled to the prototype extractor and configured to produce a plurality of phase parameters of a reference prototype of a frame, generate a plurality of linear phase shift values associated with the current prototype, and compose a phase vector from the phase parameters and the linear phase shift values across a plurality of frequency bands, wherein the prototype quantizer is further configured to unquantize a plurality of quantized phase parameters associated with the current prototype to generate the plurality of linear phase shift values.

62. The speech coder of claim 61, wherein the prototype quantizer is further configured to compute discrete Fourier series coefficients for the reference prototype and decompose the discrete Fourier series coefficients into amplitude vectors and phase vectors for the reference prototype.

63. The speech coder of claim 61, wherein the prototype quantizer is further configured to identify the plurality of frequency bands.

64. The speech coder of claim 61, wherein the current frame is a speech frame.

65. The speech coder of claim 61, wherein the current frame is a frame of linear prediction residue.

66. The speech coder of claim 63, wherein the prototype quantizer is further configured to further unquantize a plurality of amplitude quantization parameters associated with the current prototype to produce a plurality of unquantized amplitude parameters, and to identify the plurality of bands based upon the plurality of unquantized amplitude parameters.

67. The speech coder of claim 61, wherein the prototype quantizer is further configured to combine the phase vector with a plurality of amplitude parameters associated with the current prototype to produce a combined vector, and to compute an inverse discrete Fourier series of the combined vector to produce a reconstructed version of the current prototype.

68. The speech coder of claim 61, wherein the speech coder resides in a subscriber unit of a wireless communication system.

69. A speech coder, comprising:

a prototype extractor configured to extract a current prototype from a current frame being processed by the speech coder; and a prototype quantizer coupled to the prototype extractor and configured to produce a plurality of circular rotation values associated with the current prototype, generate a plurality of bandpass waveforms in a plurality of frequency bands, the plurality of bandpass waveforms being associated with a plurality of phase parameters of a reference prototype of a frame, and modify the plurality of bandpass waveforms based upon the plurality of circular rotation values.

70. The speech coder of claim 69, wherein the prototype quantizer is further configured to identify the plurality of frequency bands.

71. The speech coder of claim 69, wherein the current frame is a speech frame.

72. The speech coder of claim 69, wherein the current frame is a frame of linear prediction residue.

73. The speech coder of claim 69, wherein the prototype quantizer is further configured to unquantize a plurality of quantized phase parameters associated with the current prototype to generate the plurality of circular rotation values.

74. The speech coder of claim 70, wherein the prototype quantizer is further configured to unquantize a plurality of amplitude quantization parameters associated with the current prototype to produce a plurality of unquantized amplitude parameters, and to identify frequency bands based upon the plurality of unquantized amplitude parameters.

75. The speech coder of claim 74, wherein the prototype quantizer is further configured to compute discrete Fourier series coefficients for the reference prototype, decompose the discrete Fourier series coefficients into an amplitude vector and a phase vector for the reference prototype, combine the phase vector with the plurality of unquantized amplitude parameters, and calculate the inverse discrete Fourier series of the phase vector to generate the plurality of bandpass waveforms.

76. The speech coder of claim 69, wherein the prototype quantizer is further configured to sum the plurality of modified bandpass waveforms to produce a reconstructed version of the current prototype.

77. The speech coder of claim 69, wherein the speech coder resides in a subscriber unit of a wireless communication system.

* * * * *